United States Patent [19]

Okazaki

[11] Patent Number: 4,490,100

[45] Date of Patent: Dec. 25, 1984

[54] ROTARY VANE-TYPE COMPRESSOR WITH DISCHARGE PASSAGE IN ROTOR

[75] Inventor: Michio Okazaki, Saitama, Japan

[73] Assignee: Diesel Kiki Co., Ltd., Tokyo, Japan

[21] Appl. No.: 335,390

[22] Filed: Dec. 29, 1981

[51] Int. Cl.[3] ..... F04C 18/00; F04C 29/02

[52] U.S. Cl. ..... 10111984; 418/99; 418/185; 418/188; 418/DIG. 1

[58] Field of Search ..... 418/185, 188, 98, DIG. 1, 418/99

[56] References Cited

U.S. PATENT DOCUMENTS

| | | | |
|---|---|---|---|
| 1,409,986 | 3/1922 | White | 418/185 |
| 2,653,549 | 9/1953 | Knight | 418/185 |
| 2,937,599 | 5/1960 | Rosaen | 418/185 |
| 3,135,460 | 6/1964 | Galin | 418/188 |
| 3,184,157 | 5/1965 | Galin | 418/185 |
| 4,244,680 | 1/1981 | Ishizuka et al. | 418/DIG. 1 |
| 4,269,576 | 5/1981 | Shibuya | 418/DIG. 1 |

FOREIGN PATENT DOCUMENTS

| | | | |
|---|---|---|---|
| 690003 | 4/1953 | United Kingdom | 418/185 |

*Primary Examiner*—John J. Vrablik

*Attorney, Agent, or Firm*—Michael J. Striker

[57] ABSTRACT

A compressor, particularly such suited for use in motor vehicles, especially passenger cars, for instance, in the air conditioning systems thereof, includes a stator including a housing bounding an internal space accommodating a rotatable body of a rotor. An internal surface of the housing and an external surface of the rotatable body together form at least one compression space of a varying radial dimension as considered in the circumferential direction. The rotary body is provided with a plurality of recesses each of which partially receives a respective vane for reciprocation in contact with the internal surface of the housing, such that the vanes subdivide the compression space into a plurality of compartments. The medium to be compressed is sequentially admitted into the respective compartments through respective inlet openings provided in the stator. The compressed medium is discharged from the respective compartments through a passage provided in the interior of the rotary body. This passage communicates with a discharges space arranged at one axial end of the compressor and communicating with a discharge port.

2 Claims, 4 Drawing Figures

ROTARY VANE-TYPE COMPRESSOR WITH DISCHARGE PASSAGE IN ROTOR

BACKGROUND OF THE INVENTION

The present invention relates to compressors in general, and more particularly to a rotary vane-type compressor, especially for use in a motor vehicle.

There are already known various constructions of rotary compressors of the vane type. Usually, such a compressor includes vanes which are at least partially received in substantially radially oriented slots or recesses of the rotary body of the rotor of the compressor, the rotary body being mounted for joint rotation on a shaft which, in turn, is supported for rotation on a housing constituting at least a part of the stator of the compressor. The rotor and the stator or, more particularly, the rotary body and the housing, together define a compression space which is subdivided by the vanes into a plurality of individual and separate compartments some of which act as suction compartments while the others act as pressure compartments during the rotation of the rotor in any particular angular position of the rotary body. The medium to be compressed is admitted into the compartment which then acts as the suction compartment through an inlet port provided in the housing, while a discharge port is provided at a different region of the housing and is in communication with the respective pressure compartment for discharging the compressed medium therefrom.

In one particular construction of this type, the passage which connects the compression compartment, or a plurality of such compression compartments, as the case may be, with the discharge port is provided in the same part of the stator as the passage which communicates the inlet port with the suction compartment or suction compartment, this part also externally bounding the space accommodating the rotary body of the rotor. The need for supplying the medium to be compressed to the inlet passage and discharging the already compressed medium from the discharge passage requires the provision of housing portions which are relatively bulky or massive in order to safely overlap the respective passages or the inlet and outlet openings thereof and to prevent direct communication between the discharge and inlet ports through the interior of the housing past the rotary body. As a result of this, the compressor of this conventional construction has relatively huge radial dimensions. Of course, this results in a situation where the entire compressor is relatively voluminous and has a substantial mass or weight.

SUMMARY OF THE INVENTION

Accordingly, it is a general object of the present invention to avoid the disadvantages of the prior art.

More particularly, it is an object of the invention to develop a rotary vane-type compressor which is not possessed of the disadvantages of the conventional compressors of this type.

Still another object of the present invention is so to construct the compressor of the type here under consideration as to reduce its dimensions and weight, without sacrificing the reliability of the conventional compressors of this type.

It is yet another object of the present invention so to design the compressor as to be particularly suitable for use in motor vehicles, especially in small-size vehicles such as passenger cars.

A concomitant object of the present invention is to devise a compressor of the vane-type which is simple in construction, inexpensive to manufacture, has an extended life span without extensive maintenance, and is reliable in operation nevertheless.

In pursuance of these objects and others which will become apparent hereafter, one feature of the present invention resides in a rotary vane-type compressor which comprises a stator including a hollow housing having an internal surface bounding an internal space; a rotor including a rotary body centered on an axis and having an external surface; means for so mounting the rotor on the stator for rotation about the axis that the rotary body is accomodated in the internal space and the internal and external surfaces bound at least one compression chamber having a varying radial dimension as considered in the circumferential direction; means for delimiting at least one recess in the rotary body which opens onto the external surface; at least one vane at least partially received in the recess for joint rotation with the rotary body and for reciprocation in contact with the internal surface into and out of the recess between an extended and a retracted position thereof to subdivide the compression space into a suction and a compression compartment; means in the stator for admitting a medium to be compressed into the suction compartment; and means for discharging the compressed medium from the pressure compartment, including a discharge opening, and means defining a passage in the rotor connecting the pressure compartment with the discharge opening. A particular advantage obtained from this construction is the reduction of the overall dimensions, and thus of the weight, of the compressor as compared to the conventional constructions having the same throughput.

It is particularly advantageous when the passage-defining means bounds at least one substantially radial opening in the rotary body, this radial opening communicating with the pressure compartment, and when the passage-defining means further includes at least one passage within the confines of the rotary body, this passage communicating with the radial opening and with the discharge opening. Advantageously, the passage extends substantially axially of the rotor between the radial opening and one axial end of the rotor.

According to one advantageous concept of the present invention, the rotor further includes a shaft rotatably mounted in the housing and supporting the rotary body for joint rotation. Then, the passage is advantageously disposed substantially coaxially within the shaft. In this particular construction, it is further advantageous when the passage-defining means further includes an intermediate space within the rotary body, this intermediate space communicating with the passage and with the radial opening. Then, valve means is advantageously situated in the intermediate space, this valve means being operative for establishing and interrupting communication between the radial opening and the intermediate space. The passage-defining means advantageously further includes at least one substantially radial bore in the shaft, this bore connecting the intermediate space with the passage.

According to a further advantageous facet of the present invention, the shaft has an input end passing through the housing to the exterior of the housing and another end situated at the one axial end of the rotor.

Then, the housing advantageously further bounds a discharge chamber communicating with the discharge opening and disposed at the other end of the shaft in communication with the passage.

In a modified construction according to the present invention, the rotary body is hollow to provide the aforementioned passage. The stator further includes a partitioning wall separating the internal space from a discharge chamber. In this construction, the rotary body has a support portion at the one axial end thereof, this support portion supporting the rotary body on the partitioning wall for rotation about the axis, and the passage extending through the support portion and communicating with the discharge chamber. In this modified construction, the rotor also further includes a shaft which is rotatably mounted on the housing and has an input end which is situated at the exterior of the stator; however, this shaft only extends as far as the other axial end of the rotary body and not into the passage to support this other axial end of the rotary body on the housing for joint rotation with the shaft about the aforementioned axis. Even here, valve means is provided which is situated in the passage in this construction and is operative for establishing and interrupting communication between the radial opening of the rotary body and the passage.

The novel features which are considered as characteristic of the invention are set forth in particular in the appended claims. The improved rotary vane-type compressor itself, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
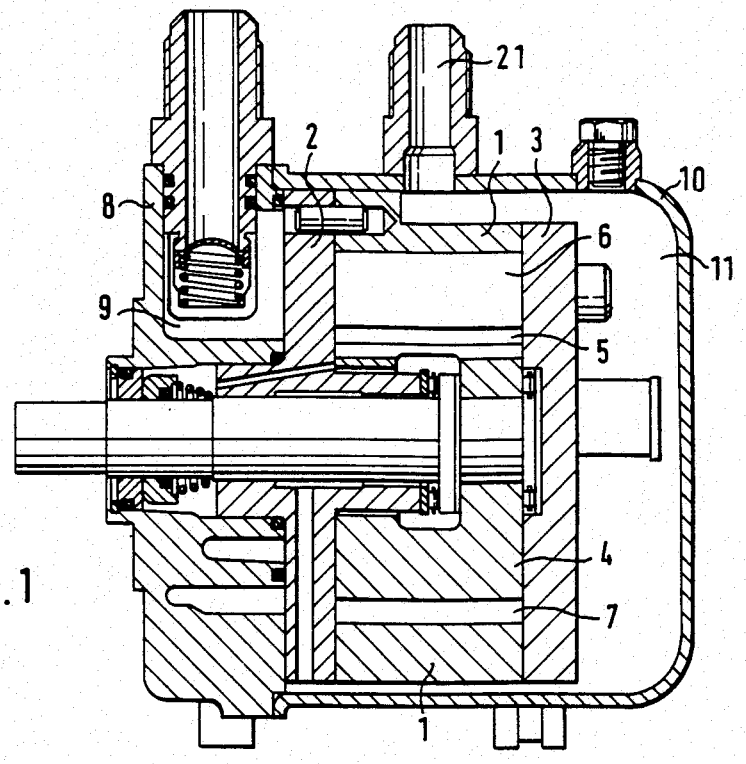
FIG. 1 is an axial sectional view of a conventional rotary vane-type compressor.

Referring now to the drawing in detail, and first to FIG. 1 thereof, it may be seen that a conventional rotary vane-type compressor depicted in FIG. 1, which may find its use, for instance, in air-conditioning equipment of a motor vehicle or the like, includes a stroke-determining ring 1 on which there are mounted, at the respective axial ends, respective axial lids 2 and 3. The components 1 to 3 together define an enclosed internal space in which there is accommodated, for free rotation, a rotary body 4. A plurality of slots or recesses 5 is formed in the rotary body 4. Respective vanes 6 are at least partially received in their associated slots 5 for reciprocation in substantially radial directions into and out of the slot or recesses 6 between the extended and retracted positions of the respective vanes 6. The compression space which is outwardly delimited by the internal surface of the stroke-determining ring 1 and inwardly delimited by the external surface of the rotary body 4 is subdivided by the vanes 6 into individual and separate compartments 7. The volume of such compartments 7 in gradually alternately increased and decreased during the rotation of the rotary body 4, so that the compartments 7 alternately act as suction compartments to draw the medium to be compressed thereinto and as pressure compartments in which the medium is compressed. The low-pressure medium is introduced into the respective suction compartment from a supply chamber 9 which is situated between the axial lid 2 and an outer lid 8 which is affixed to the axial lid 2 at the outer side of the latter, through an inlet opening which is provided in the stroke-determining ring 1, that is, in the stator. This inlet opening has been omitted from the drawing. The inlet opening admits the low-pressure medium into the respective suction compartment 7 which is then in communication therewith. The medium which is eventually pressurized as the size of the compartment 7 containing the same decreases while this compartment acts as the pressure compartment, is discharged from the respective pressure compartment 7 through an outlet opening which has also been omitted from the drawing but which is also provided in the stroke-determining ring 1 into a high-pressure or discharge chamber 11 which is bounded by the stroke-determining ring 1, the axial lid 3, and an outer housing 10 of the stator. The compressed or pressurized medium is discharged from the discharge chamber through a discharge port or nipple 21.

In this rotary vane-type compressor having conventional construction, there must be formed the discharge chamber 11 which overlaps the stroke-determining ring in the radial direction, inasmuch as the stroke-determining ring 1 includes, in addition to the inlet opening for the low-pressure medium to be compressed, also the outlet opening for the compressed medium. This is achieved by equipping the stator with the outer housing 10. However, as mentioned above, this construction is disadvantageous since the outer dimensions, and also the mass, of the compressor are excessive. In addition thereto, the low-pressure or supply chamber 9 is provided in a special outer lid 8 which is affixed to the outer side of the axial lid 2. Even this results in a situation where the space occupied by, and the weight of, the compressor are too large.

The improvement accomplished by the present invention will now be explained with reference to FIGS. 2 to 4.

Figure 3:
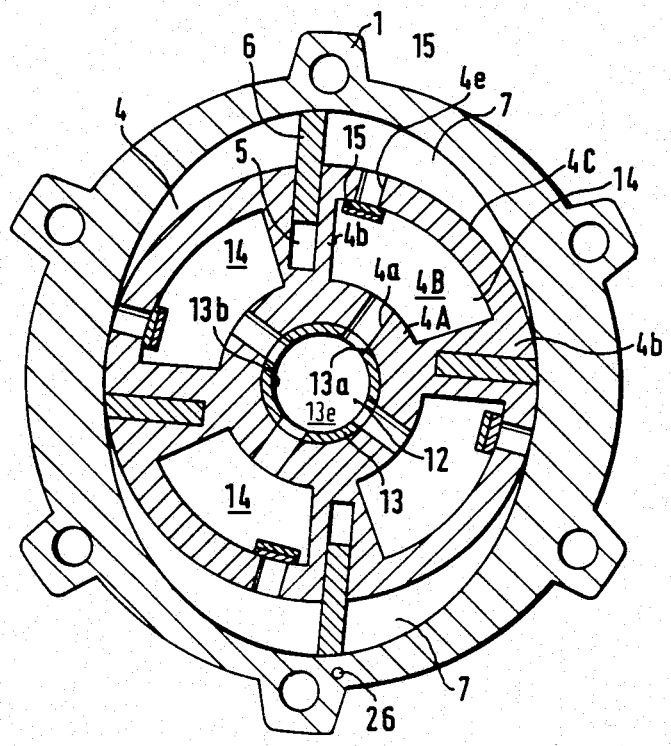
FIG. 3 is a cross-sectional view of the construction of FIG. 2, taken on line III—III of FIG. 2.
Figure 2:
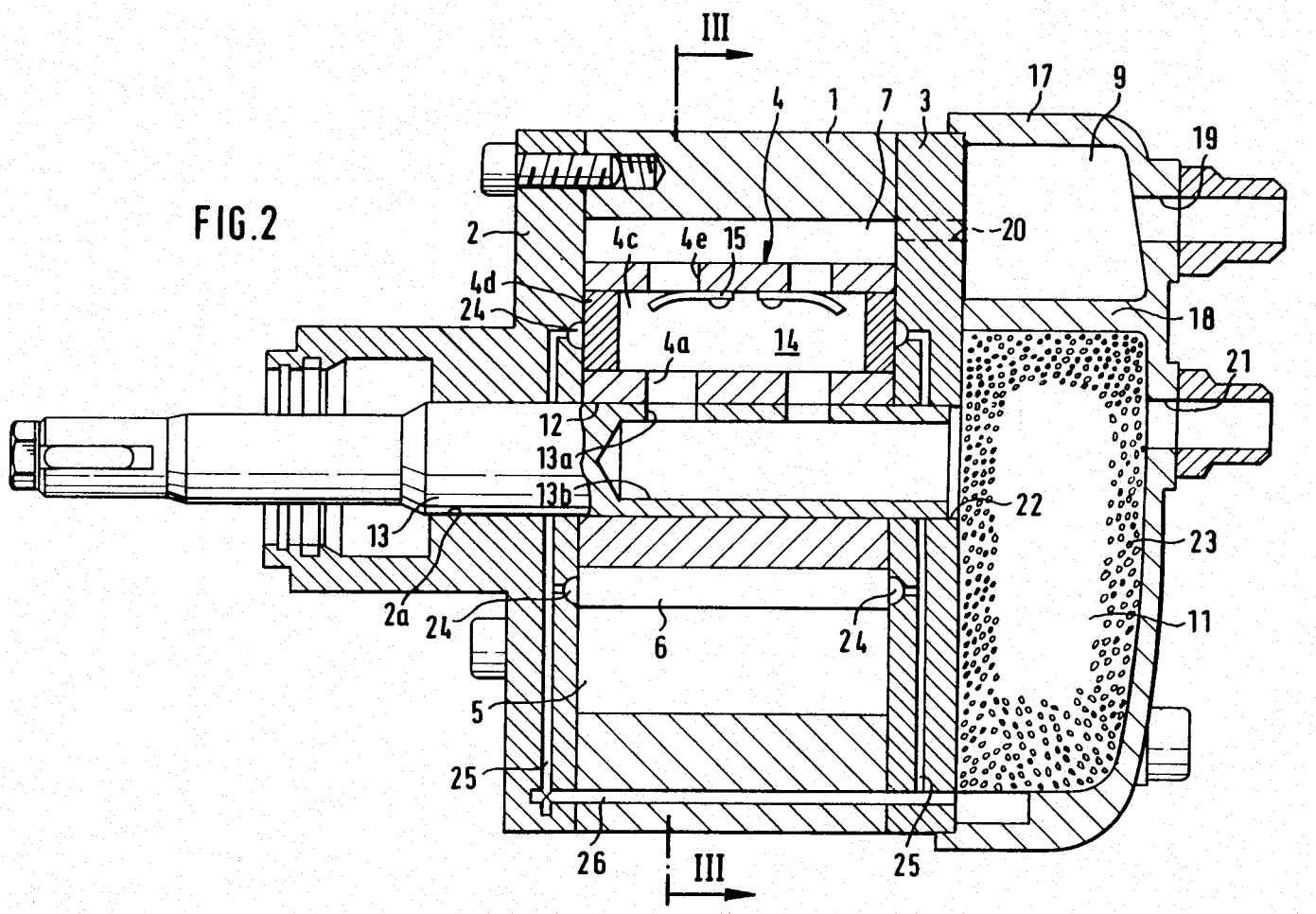
FIG. 2 is an axial sectional view of one construction of the rotary vane-type compressor according to the present invention, taken on line II—II of FIG. 3.

Turning first to FIGS. 2 and 3, it is to be mentioned first that, to the extent possible, the same reference numerals as used in connection with FIG. 1 are being used here to identify the same or corresponding parts or components. The rotary body 4 shown in FIGS. 2 and 3 includes a hub portion 4A, intermediate portions 4B, and a cylindrical jacket portion 4C. In this manner, enlarged intermediate spaces or passages 14 are formed in the interior of the rotary body 4. The hub portions 4A extends over the entire axial length of the rotary body 4. Substantially radially extending bores or openings **4*a* are formed, such as drilled, through the hub portion 4A in one or more rows. A shaft 13 is partially received in an axial bore 12 of the hub portion 4A**.

The intermediate portions 4B of the rotary body 4 are made of one piece with the hub portion 4A and with the jacket portion 4C. The vanes 6 are guided in the slots 5, which are provided in the intermediate portions 4B, for sliding in a sealed manner. The radially outer surface of the respective vane 6 is in a sliding contact with the inner surface of the stroke-determining ring 1 which radially outwardly delimits the internal space which accommodates the rotary body 4. Here again, as in the conventional compressor, the internal space of the stroke-determining ring 1 is axially closed by flat surfaces of two axial lids 2 and 3 which are attached or supported on the ring 1 at the two axial ends thereof. The vanes 6 subdivide the compression chamber present between the internal surface of the stroke-determining ring 1 and the external surface of the jacket portion 4C of the rotary body 4 into separate compartments 7. This can best be seen in FIG. 3.

Each of the compartments 7 is connected to the intermediate spaces 14 provided in the interior of the rotary body 4 by openings **4*e* which penetrate through the jacket portion 4C of the rotary body 4. The intermediate spaces 14, in turn, are connected via the aforementioned through bores 4*a* provided in the hub portion 4A and via associated substantially radial bores 13*a* provided in the shaft 13 with a discharge channel or passage 13*b* which extends axially of the shaft 13 substantially coaxially therewith. The discharge channel 13*b* has the shape of a concentric bore in the shaft 13, which communicates, at the end remote from the input or driving end of the shaft 13, with a high-pressure or discharge chamber 11**.

At the inner end of each of the radial bores or openings **4*e* which are adapted to convey the compressed medium, there is provided a pressure or one-way valve 15 of a conventional construction, which closes the respectively associated opening 4*e* in its closing position, but which can be opened in direction toward the intermediate space 14** by the pressure differential acting thereon.

A hood-shaped lid 17 is affixed to the side of the axial lid 3 which faces away from the rotary body 4. The space which is delimited by this lid 17 is subdivided by a partitioning wall 18 into the low-pressure or supply chamber 9 and the high-pressure or discharge chamber 11. The supply chamber 9 and the discharge chamber 11 are connectable, by means of respective ports or nipples 19 and 21, to respective conduits of the circuit incorporating the compressor, which conduits have been omitted for the sake of clarity.

As shown in FIG. 2, the high-pressure or discharge chamber 11 is filled with a filter or a similar body permeable to the medium but capable of capturing impurities, such as oil droplets, entrained in the compressed medium. This filter or oil-capturing element, identified by the reference numeral 23, can be constructed, for instance, as a coagulator.

As can best be seen in FIG. 2, the driving shaft 13 is supported, on the one hand, in a bearing opening **2*a* of the axial lid 2 and, on the other hand, in a bearing opening 22 of the axial lid 3**.

Annular grooves 24 are formed in the axial end faces of the axial lids 2 and 3 which face the rotary body 4. These annular grooves 24 are connected with oil-conveying channels or ducts 25 and 26 which, in turn, are connected to the high-pressure chamber 11 which is filled with the oil-capturing element 23.

Having no described the construction of the compressor illustrated in FIGS. 2 and 3, the operation thereof will now be discussed.

The medium to be compressed, such as a coolant, which has entered the low-pressure or supply chamber 9 through the inlet port 19, is drawn into the respective suction compartment 7 through the respective opening 20. Thereafter, the medium present in the respective compartment 7 is compressed during the rotation of the rotary body 4 in the part of the path of movement of the vanes 6 in which they are retracted in contact with the stator, so that the volume of the respective compartment 7 is reduced and, consequently, this compartment constitutes a pressure compartment. The pressure of the compressed medium present in the respective pressure compartment 7 opens the associated one-way or check valve 15, so that the compressed medium can and does flow through the respective opening or bore **4*e* into the respective intermediate space 14. From there, the compressed medium flows through the through bores 4*a*, the bores 13*a* and the discharge channel or passage 13*b* into the discharge chamber 11. In the discharge chamber 11, the pressurized medium is rid of the entrained lubricating oil by means of the oil-capturing or segregating element 23. The compressed coolant or similar medium can now leave the discharge chamber 11 through the discharge port or nipple 21. The segreagated or captured lubricating oil is collected at the bottom of the discharge chamber 11, from where it can flow through the oil-conveying ducts or channels 25 to the contact surfaces between the rotary body 4 and the axial lids 2 and 3** which are to be lubricated.

Of course, it is desirable to arrange the respective opening or bore **4*e* as close as possible to that of the vanes 6 delimiting the respective compartment 7 which is trailing as considered in the direction of rotation 30, in order to keep the loss of usable space of the respective compartment 7** to a mininum.

Figure 4:
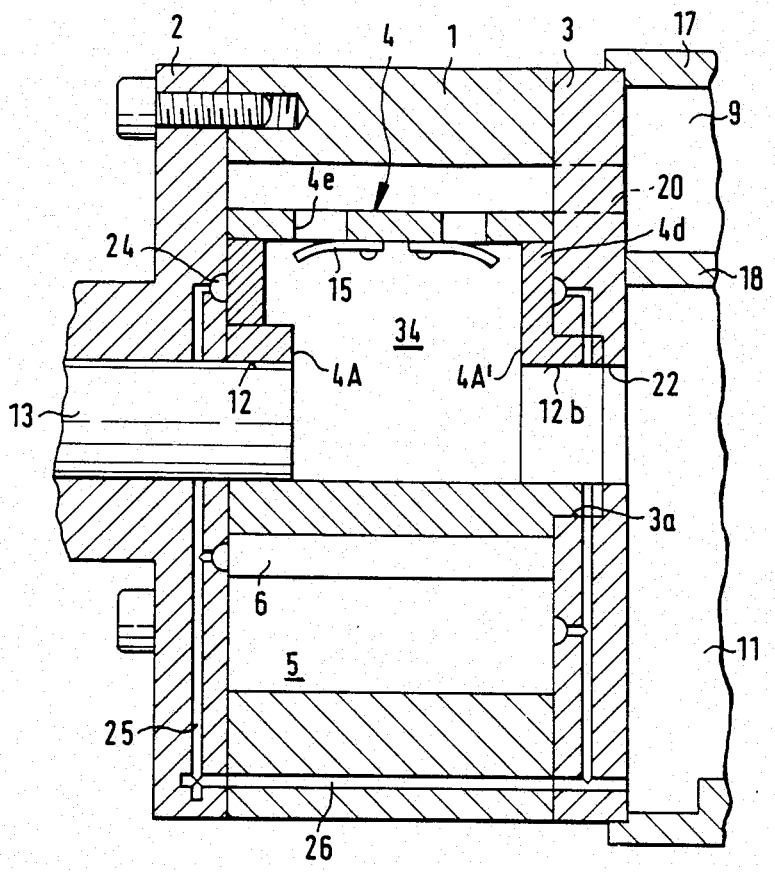
FIG. 4 is a view similar to FIG. 2 but only of a fragment of a modified construction of the rotary vane-type compressor according to the present invention.

FIG. 4 illustrates a modification of the construction of the compressor of the present invention which is similar to that depicted in FIGS. 2 and 3 in so many respects that only that portion of the compressor which is modified need be and has been illustrated, that the same reference numerals can be and have been used to identify corresponding parts, and that only the differences in construction need and will be discussed in detail.

In the modified construction of FIG. 4, the enlarged spaces associated with the respective openings or bores **4*e* are united into a single internal space or passage 34 in the rotary body 4. The hub portion 4A of the construction of FIG. 4 is substantially shortened in the axial direction as compared to that of FIGS. 2 and 3, and so is the shaft 13 which reaches from the exterior of the stator only as far as the shortened hub portion 4A to support the same for rotation on the axial lid 2. At its other axial end, the rotary body 4 is rotatably supported on the other axial lid 3 by means of a bearing portion 4A' provided on an end wall 4*d* of the rotary body 4 and received in a bearing aperture 3*a* of the axial lid 3. The passage 34 is connected with the discharge chamber 11 by means of a discharge channel or opening 12*b* which is provided in and passes through the bearing portion 4A'**, advantageously coaxially therewith. This construction differs from the above-discussed one in that the compressor may be made with even smaller dimensions and weight than the above-discussed one.

It will be understood that each of the elements described above, or two or more together, may also find a useful application in other types of arrangements differing from the type described above.

While the invention has been illustrated and described as embodied in a compressor for use in motor vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A rotary vane-type compressor, comprising a stator including a hollow housing having an internal surface bounding an internal space; a rotor including a rotary body centered on an axis and having an external surface and a shaft rotatably mounted in said housing and supporting said rotary body for joint rotation, said shaft having an input end passing through said housing to the exterior of said housing and another end; means for so mounting said rotor on said stator for rotation about said axis so that said rotary body is accommodated in said internal space and said internal and external surfaces bound at least one compression chamber having a varying radial dimension as considered in the circumferential direction; means for delimiting at least one recess in said rotary body which opens into said external surface; at lease one vane at least partially received in said recess for joint rotation with said rotary body and for reciprocation in contact with said internal surface into and out of said recess between an extended and a retracted position thereof to subdivide said compression chamber into a pressure and a suction compartment; means in said stator for admitting a medium to be compressed into said suction compartment; means for discharging the compressed medium from said pressure compartment, including a discharge opening; means defining at least one passage in said rotor connecting said pressure compartment with said discharge opening; means for lubricating said rotor and said shaft with oil; said passage-defining means including at least one substantially radial opening formed in said rotary body and communicating with said pressure compartment, at least one passage within the confines of said rotary body and extending coaxially with said shaft and communicating said opening with said discharge opening, and least one intermediate chamber within said rotary body and communicating with said opening and with said passage; valves means situated in said intermediate chamber and operative for establishing and interrupting communication between said opening and said intermediate chamber, said housing bounding a discharge chamber communicating with said discharge opening and disposed at said another end of said shaft in communication with said passage; said discharge chamber being filled with a filter body permeable to the medium but impermeable to oil and operative for capturing oil entrained in the compressed medium as it flows through said passage-defining means; and said lubricating means including oil-conveying ducts formed in said housing and opening adjacent to said rotary body and connected to said discharge chamber.

2. The compressor as defined in claim 1, wherein said passage-defining means further includes at least one substantially radial bore in said shaft connecting said intermediate chamber with said passage.

* * * * *